US010680329B2

(12) United States Patent
Clemente et al.

(10) Patent No.: US 10,680,329 B2
(45) Date of Patent: Jun. 9, 2020

(54) UNIT CELL OF A TRANSMISSION NETWORK FOR A RECONFIGURABLE ANTENNA

(71) Applicant: Commissariat a l'energie atomique et aux energies alternatives, Paris (FR)

(72) Inventors: Antonio Clemente, Seyssins (FR); Laurent Dussopt, Grenoble (FR); Luca Di Palma, Rome (IT)

(73) Assignee: Commissariat a l'energie atomique et aux energies alternatives, Paris (FR)

( * ) Notice: Subject to any disclaimer, the term of this patent is extended or adjusted under 35 U.S.C. 154(b) by 238 days.

(21) Appl. No.: 15/951,680

(22) Filed: Apr. 12, 2018

(65) Prior Publication Data

US 2018/0301807 A1 Oct. 18, 2018

(30) Foreign Application Priority Data

Apr. 14, 2017 (FR) ..... 17 53285

(51) Int. Cl.
*H01Q 3/34* (2006.01)
*H01Q 1/48* (2006.01)
(Continued)

(52) U.S. Cl.
CPC ..... *H01Q 3/34* (2013.01); *H01Q 1/2283* (2013.01); *H01Q 1/48* (2013.01); *H01Q 3/46* (2013.01);
(Continued)

(58) Field of Classification Search
CPC ... G01S 1/02; H01Q 3/22; H01Q 3/34; H01Q 3/42; H01Q 3/46; H01Q 1/2283;
(Continued)

(56) References Cited

U.S. PATENT DOCUMENTS 4,305,052 A 12/1981 Baril et al.
6,184,828 B1 2/2001 Shoki
(Continued)

FOREIGN PATENT DOCUMENTS

FR 2 445 036 7/1980
FR 2 969 832 6/2012
WO WO 2009/023551 A1 2/2009

OTHER PUBLICATIONS

French Preliminary Search Report dated Feb. 7, 2018 in French Application 17 53285 filed on Apr. 14, 2017 (with English Translation of Categories of Cited Documents and Written Opinion).
(Continued)

*Primary Examiner* — Harry K Liu
(74) *Attorney, Agent, or Firm* — Oblon, McClelland, Maier & Neustadt, L.L.P.

(57) ABSTRACT

This unit cell comprises:
- a patch reception antenna;
- a patch transmission antenna, and comprising first and second separate radiation surfaces;
- a first phase-shift circuit, comprising first and second switches respectively exhibiting an on state and an off state, alternately, between the first and second radiation surfaces of the transmission antenna;

and is noteworthy in that the reception antenna comprises first and second separate collection surfaces; and in that the unit cell comprises a second phase-shift circuit comprising first and second switches respectively exhibiting an on state and an off state, alternately, between the first and second collection surfaces of the reception antenna.

11 Claims, 2 Drawing Sheets

(51) Int. Cl.

| | |
|---|---|
| ***H01Q 15/24*** | (2006.01) |
| ***H01Q 9/04*** | (2006.01) |
| ***H01Q 21/00*** | (2006.01) |
| ***H01Q 1/22*** | (2006.01) |
| ***H01Q 3/46*** | (2006.01) |

(52) U.S. Cl.
CPC ..... *H01Q 9/0407* (2013.01); *H01Q 15/24* (2013.01); *H01Q 21/0093* (2013.01)

(58) Field of Classification Search
CPC ..... H01Q 1/48; H01Q 9/0407; H01Q 15/24; H01Q 25/00
USPC ..... 342/371
See application file for complete search history.

(56) References Cited

U.S. PATENT DOCUMENTS

| | | | | |
|---|---|---|---|---|
| 6,556,168 | B1 | 4/2003 | Marumoto et al. | |
| 7,030,824 | B1 | 4/2006 | Taft et al. | |
| 7,791,552 | B1 * | 9/2010 | Romanofsky ..... | H01Q 15/148 343/700 MS |
| 2013/0271346 | A1 | 10/2013 | Dussopt et al. | |
| 2019/0020122 | A1 * | 1/2019 | Hester ..... | H01Q 1/38 |

OTHER PUBLICATIONS

Lau, J. et al., "A Planar Reconfigurable Aperture With Lens and Reflectarray Modes of Operation," IEEE Transactions on Microwave Theory and Techniques, Dec. 2010, vol. 58, No. 12, pp. 3547-3555.
Lau, J. et al., "A Wideband Reconfigurable Transmitarray Element," IEEE Transactions on Antennas and Propagation, Mar. 2012, vol. 60, No. 3, pp. 1303-1311.
Cheng, C. et al., "A Programmable Lens-Array Antenna With Monolithically Integrated MEMS Switches," IEEE Transactions on Microwave Theory and Techniques, Aug. 2009, vol. 57, No. 8, pp. 1874-1884.
Clemente, A. et al., "1-Bit Reconfigurable Unit-Cell Based on PIN Diodes for Transmitarray Application in X-band," IEEE Transactions on Antennas and Propagation., May 2012, vol. 60, No. 5, pp. 2260-2269.
Di Palma, L. et al., "1-Bit Reconfigurable Unit-Cell for Ka-Band Transmitarrays," IEEE Antennas and Wireless Propagation Letters, 2016, vol. 15, pp. 560-563.
Clemente, A. et al. "Reconfigurable Unit-cells for Beam-Scanning Transmitarray in X Band", 7th European Conf. on Antennas and Propagation (EUCAP 2013),I 2013, pp. 1783-1787.
Pan, W. et al., "A Dual Linearly Polarized Transmitarray Element With 1-Bit Phase Resolution in X-Band," IEEE Antennas and Wireless Propagation Letters, 2015, vol. 14, pp. 167-169.

* cited by examiner

UNIT CELL OF A TRANSMISSION NETWORK FOR A RECONFIGURABLE ANTENNA

TECHNICAL FIELD

The invention relates to a unit cell of a transmitarray for a reconfigurable antenna with an operating frequency, preferably lying between 4 GHz and 170 GHz. The invention relates also to a reconfigurable antenna comprising a transmitarray comprising such unit cells.

"Reconfigurable" should be understood to mean that at least one characteristic of the antenna can be modified during its lifetime, after the manufacture thereof. The characteristic or characteristics that are generally modifiable are the frequency response (in amplitude and in phase), the radiation pattern (also called beam), and the polarization. The reconfiguration of the frequency response covers different functionalities such as frequency switching, frequency tuning, bandwidth variation, phase-shifting, frequency filtering, etc. The reconfiguration of the radiation pattern covers different functionalities such as the angular scanning of the beam pointing direction (also called misalignment), the aperture of the beam (that is to say the concentration of the radiation in a particular direction), the spatial filtering, the forming of a beam or of a multibeam (for example several narrow beams replacing a wide beam) etc.

Regarding the reconfiguration of the radiation pattern, there are different types of reconfigurable antenna, in particular:

a phased array antenna, a reflectarray antenna, a transmitarray antenna.

The technical field of the invention relates more specifically to a reconfigurable antenna of transmitarray type.

Such reconfigurable antennas are particularly advantageous from the C-band (4-8 GHz) to the D-band (110-170 GHz) for the following applications:

motor vehicle driving assistance and aid radars, for active safety, very high resolution imaging and monitoring systems, millimetric wave very high bit rate communication systems (inter-building or intra-building communications in a short-range linked home automation or building automation environment), ground-low-earth orbit LEO satellite telemetry links in the Ka band, satellite telecommunications with reconfigurable primary feed (SOTM™ for "Satcom-on-the-Move", Internet, television etc.), point-to-point and point-to-multipoint link systems (metropolitan area networks, "Fronthaul" and "Backhaul" systems for cellular networks, radio access for fifth generation mobile networks, etc.).

PRIOR ART

A unit cell of a transmitarray for a reconfigurable antenna known from the prior art, in particular from the document WO 2012/085067, comprises:

a patch reception antenna, intended to receive an incident wave;

a patch transmission antenna, intended to transmit the incident wave with a phase shift, and comprising first and second separate radiation surfaces;

a phase-shift circuit, configured to define a pair of phase states for the incident wave; the phase-shift circuit comprising first and second switches respectively exhibiting an on state and an off state, alternately; the on or off states corresponding to a circulation of a current, respectively authorized or blocked, between the first and second separate radiation surfaces of the transmission antenna.

Such a unit cell of the prior art is not entirely satisfactory in as much as it can generate only two phase states for the transmission of the incident wave. The two phase states are separated by 180° in as much as the first and second switches, respectively exhibiting an on state and an off state and controlled alternately, excite the transmission antenna in phase or in phase opposition with the reception antenna. In other words, the transmission phase is controlled with a quantization of 1 bit, that is to say two phase states at 0° or 180°. This quantization of 1 bit is likely to limit the performance levels of the transmitarray-type reconfigurable antenna, in particular in terms of directivity, and consequently of gain, and of side lobe level (SLL).

SUMMARY OF THE INVENTION

The invention aims to remedy all or some of the above-mentioned drawbacks. To this end, the subject of the invention is a unit cell of a transmitarray for a reconfigurable antenna with an operating frequency, the unit cell comprising:

a patch reception antenna, intended to receive an incident wave;

a patch transmission antenna, intended to transmit the incident wave with a phase shift, and comprising first and second separate radiation surfaces;

a first phase-shift circuit, configured to define a first pair of phase states for the incident wave; the first phase-shift circuit comprising first and second switches respectively exhibiting an on state and an off state, alternately; the on or off states corresponding to a circulation of a current, respectively authorized or blocked, between the first and second separate radiation surfaces of the transmission antenna;

the unit cell being noteworthy in that the reception antenna comprises first and second separate collection surfaces; and in that the unit cell comprises a second phase-shift circuit, configured to define a second pair of phase states for the incident wave; the second phase-shift circuit comprising first and second switches respectively exhibiting an on state and an off state, alternately; the on or off states corresponding to a circulation of a current, respectively authorized or blocked, between the first and second separate collection surfaces of the reception antenna.

Thus, such a unit cell according to the invention makes it possible, by virtue of such a reception antenna and the second phase-shift circuit, to obtain a second pair of phase states for the transmission of the incident wave. Such a unit cell can therefore generate four phase states for the transmission of the incident wave. The phase states in each pair are separated by 180° in that the switches of the first and second phase-shift circuits excite the transmission antenna (respectively the reception antenna) in phase or in phase opposition with the reception antenna (respectively the transmission antenna). In other words, the transmission phase is controlled with a quantization of 2 bits, and not simply 1 bit as in the prior art. This quantization on 2 bits makes it possible to envisage an improvement in the performance levels of the transmitarray-type reconfigurable antenna, in particular in terms of directivity, and consequently of gain, and of side lobe level.

Definitions

"separate" should be understood to mean that the first and second radiation (and collection) surfaces are separated from one another by a separation zone so as to be electrically insulated.

"alternately" should be understood to mean that the first switch alternates between the on state and the off state, while, simultaneously, the second switch belonging to the same phase-shift circuit alternates between the off state and the on state. In other words, at any instant, the first and second switches belonging to the same phase-shift circuit exhibit two opposing states, either on/off, or off/on. The on/on or off/off states are not authorized.

The unit cell according to the invention can comprise one or more of the following features.

According to a feature of the invention, the unit cell comprises a delay line configured such that the second pair of phase states is phase-shifted by 90° relative to the first pair of phase states.

"Line" should be understood to mean a track produced in an electrically conductive material.

"Electrically conductive" should be understood to mean that the material exhibits an electrical conductivity at 300 K greater than $10^3$ S/cm.

Thus, one advantage that is procured is obtaining the following four phase states: 0°, 90°, 180° and 270°. These four phase states are particularly advantageous because they make it possible to improve the focusing capacity of the transmitarray and consequently the gain.

According to a feature of the invention, the delay line extends from the reception antenna.

Thus, it is preferable to incorporate the delay line with the reception antenna rather than within the phase-shift circuits. In effect, the delay line has a length adapted to the desired phase-shift. In case of correction or of modification of the desired phase shift, the reception antenna remains easily accessible to modify the delay line, unlike the phase-shift circuits arranged within the architecture of the unit cell.

According to a feature of the invention, the unit cell comprises a first dielectric substrate comprising:

a first surface, provided with the reception antenna;

a second surface, opposite the first surface, and provided with polarization lines arranged to polarize the first and second switches of the second phase-shift circuit.

"Dielectric substrate" should be understood to mean a substrate produced in a material exhibiting an electrical conductivity at 300 K less than $10^{-8}$ S/cm.

Thus, one advantage that is procured is authorizing a polarization of the switches with a minimal bulk, and without disrupting the collection pattern of the reception antenna.

According to a feature of the invention, the unit cell comprises a second dielectric substrate comprising:

a first surface, provided with a ground plane;

a second surface, opposite the first surface.

Thus, one advantage that is procured by the ground plane is an electromagnetic shielding between the reception antenna and the transmission antenna.

According to a feature of the invention, the second surface of the second dielectric substrate is provided with quarter-wave lines electrically connected to the ground plane.

"Quarter-wave line" should be understood to mean a line having a length equal to a quarter of the operating wavelength of the antenna.

Thus, one advantage that is procured by such lines is forming an open circuit (impedance tends toward infinity) at the operating frequency.

According to a feature of the invention, the unit cell comprises a first bonding film arranged to bond the second surface of the second dielectric substrate onto the second surface of the first dielectric substrate.

Thus, one advantage that is procured by such a bonding film is being able to secure the first and second dielectric substrates with a minimal bulk.

According to a feature of the invention, the unit cell comprises a third dielectric substrate comprising:

a first surface, provided with the transmission antenna;

a second surface, opposite the first surface, and provided with polarization lines arranged to polarize the first and second switches of the first phase-shift circuit.

Thus, one advantage that is procured is authorizing a polarization of the switches with a minimal bulk, and without disturbing the radiation pattern of the transmission antenna.

According to a feature of the invention, the unit cell comprises a second bonding film arranged to bond the second surface of the third dielectric substrate onto the first surface of the second dielectric substrate.

Thus, one advantage that is procured for such a bonding film is being able to secure the second and third dielectric substrates with a minimal bulk.

According to a feature of the invention, the unit cell comprises a main via, arranged to electrically connect the reception antenna and the transmission antenna; the main via passing through the first, second, and third dielectric substrates and the first and second bonding films; the main via being electrically insulated from the ground plane; the main via being connected to the quarter-wave lines.

Also a subject of the invention is a reconfigurable antenna with an operating frequency, comprising a transmitarray comprising a set of unit cells according to the invention.

BRIEF DESCRIPTION OF THE DRAWINGS

Other features and advantages will become apparent from the detailed explanation of different embodiments of the invention, the explanation being accompanied by examples and reference to the attached drawings.

DETAILED DESCRIPTION OF EMBODIMENTS

The elements that are identical or ensure the same function will bear the same references for the different embodiments, in the interests of simplification.

Figure 1:
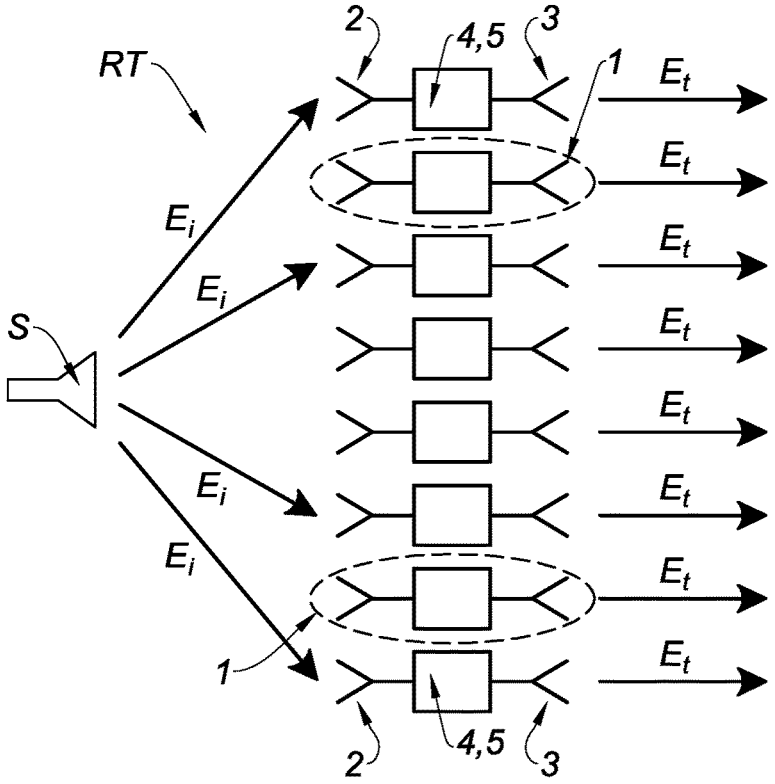
FIG. 1 is a schematic view of a reconfigurable transmitarray antenna.

One subject of the invention is a unit cell 1 of a transmitarray RT for a reconfigurable antenna with an operating frequency, the unit cell 1 comprising:

a patch reception antenna 2, intended to receive an incident wave $E_i$;

a patch transmission antenna 3, intended to transmit the incident wave $E_i$ with a phase shift (the phase-shifted transmitted wave $E_t$ being illustrated in FIG. 1), and comprising first and second separate radiation surfaces 30, 31;

a first phase-shift circuit 4, configured to define a first pair of phase states for the incident wave $E_i$; the first phase-shift circuit 4 comprising first and second switches 40, 41 respectively exhibiting an on state and an off state, alternately; the on or off states corresponding to a circulation of a current, respectively authorized or blocked, between the first and second separate radiation surfaces 30, 31 of the transmission antenna 3;

the unit cell 1 being noteworthy in that the reception antenna 2 comprises first and second separate collection surfaces 20, 21; and in that the unit cell 1 comprises a second phase-shift circuit 5, configured to define a second pair of phase states for the incident wave $E_i$; the second phase-shift circuit 5 comprising first and second switches 50, 51 respectively exhibiting an on state and an off state, alternately; the on or off states corresponding to a circulation of a current, respectively authorized or blocked, between the first and second separate collection surfaces 20, 21 of the reception antenna 2.

Reception Antenna

The unit cell 1 advantageously comprises a first dielectric substrate 6 comprising:

a first surface 60, provided with the reception antenna 2;

a second surface 61, opposite the first surface 60, and provided with polarization lines 610 arranged to polarize the first and second switches 50, 51 of the second phase-shift circuit 5.

As a nonlimiting example, the first dielectric substrate 6 can have a thickness of the order of 254 μm when the operating frequency is 29 GHz. As a nonlimiting example, the first dielectric substrate 6 can be produced in a commercial material such as RT/Duroid® 6002.

The reception antenna 2 is a patch antenna. The first and second collection surfaces 20, 21 are arranged to collect the incident wave $E_i$. The first and second collection surfaces 20, 21 are separate in as much as they are separated from one another by a separation zone ZS1 so as to be electrically insulated from one another. To this end, a slit is advantageously formed in the reception antenna 2 to electrically insulate the first and second collection surfaces 20, 21. The slit defines the separation zone ZS1. The slit is preferentially annular, with rectangular section. Obviously, other forms can be envisaged for the slit, such as an elliptical or circular form. According to an execution variant, the electrical insulation of the first and second collection surfaces 20, 21 can be ensured by a dielectric material.

The first and second collection surfaces 20, 21 advantageously have an axis of symmetry so as not to degrade the polarization of the incident wave $E_i$. The first collection surface 20 preferentially forms a ring of rectangular section. The second collection surface 21 preferentially forms a rectangular strip. The second collection surface 21 is advantageously circumscribed by the first collection surface 20 in order to avoid the formation of stray currents. The first and second separate collection surfaces 20, 21 are preferentially produced in a metallic material, more preferentially copper. Additional collection surfaces can advantageously be stacked on the first and second collection surfaces 20, 21 in order to increase the bandwidth of the reception antenna 2.

Figure 3:
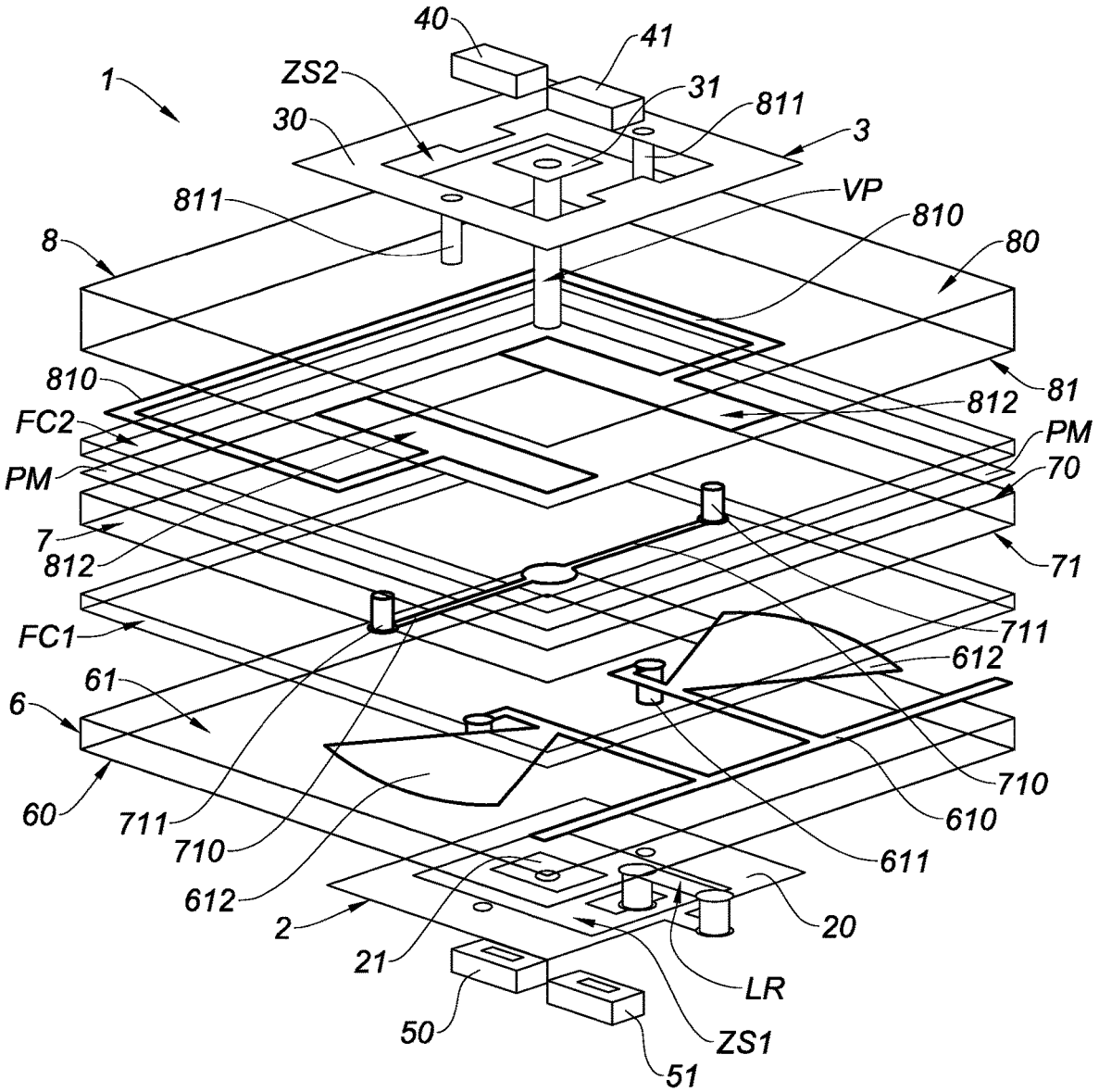
FIG. 3 is an exploded perspective and transparent schematic view of a unit cell according to the invention.

The unit cell 1 advantageously comprises a delay line LR configured such that the second pair of phase states is phase-shifted by 90° relative to the first pair of phase states. For this, the delay line LR has a length adapted so that the second pair of phase states is phase-shifted by 90° relative to the first pair of phase states. The delay line LR advantageously extends from the reception antenna 2. More specifically, as illustrated in FIG. 3, the delay line LR extends from the first collection surface 20 of the reception antenna 2. The delay line LR is preferentially produced in a metallic material, more preferentially copper.

Ground Plane

The unit cell 1 advantageously comprises a second dielectric substrate 7 comprising:

a first surface 70, provided with a ground plane PM;

a second surface 71, opposite the first surface 70.

As a nonlimiting example, the second dielectric substrate 7 can have a thickness of the order of 254 μm when the operating frequency is 29 GHz. As a nonlimiting example, the second dielectric substrate 7 can be produced in a commercial material such as RT/Duroid® 6002.

The ground plane PM is preferentially produced in a metallic material, more preferentially copper. As a nonlimiting example, the ground plane PM can have a thickness of the order of 17 μm when the operating frequency is 29 GHz.

The second surface 71 of the second dielectric substrate 7 is advantageously provided with quarter-wave lines 710 electrically connected to the ground plane PM by a via 711 passing through the second dielectric substrate 7. The quarter-wave lines 710 are preferentially produced in a metallic material, more preferentially copper.

Transmission Antenna

The unit cell 1 advantageously comprises a third dielectric substrate 8 comprising:

a first surface 80, provided with the transmission antenna 3;

a second surface 81, opposite the first surface 80, and provided with polarization lines 810 arranged to polarize the first and second switches 40, 41 of the first phase-shift circuit 4.

As a nonlimiting example, the third dielectric substrate 8 can have a thickness of the order of 508 μm when the operating frequency is 29 GHz. As a nonlimiting example, the third dielectric substrate 8 can be produced in a commercial material such as RT/Duroid® 6002.

The transmission antenna 3 is a patch antenna. The first and second radiation surfaces 30, 31 are separate in as much as they are separated from one another by a separation zone ZS2 so as to be electrically insulated from one another. To this end, a slit is advantageously formed in the transmission antenna 3 to electrically insulate the first and second radiation surfaces 30, 31. The slit defines the separation zone ZS2. The slit is preferentially annular, with rectangular section. Obviously, other forms can be envisaged for the slit, such as an elliptical or circular form. According to an execution variant, the electrical insulation of the first and second radiation surfaces 30, 31 can be ensured by a dielectric material.

The first and second radiation surfaces 30, 31 advantageously have an axis of symmetry in order to not degrade the polarization of the wave transmitted $E_t$ by the transmission antenna 3 in minimizing the excitation of unwanted resonance modes. The first radiation surface 30 preferentially forms a ring with rectangular section. The second radiation surface 31 preferentially forms a rectangular strip. The second radiation surface 31 is advantageously circumscribed by the first radiation surface 30 in order to avoid the formation of stray currents. The first and second radiation surfaces 30, 31 are preferentially produced in a metallic material, more preferentially copper. Additional radiation surfaces can advantageously be stacked on the first and second radiation surfaces 30, 31 in order to increase the bandwidth of the transmission antenna 3.

The reception antenna 2 and the transmission antenna 3 can advantageously be oriented relative to one another so as to modify the polarization of the incident wave $E_i$. Thus, a rotation of the transmission antenna 3 of 90° relative to the reception antenna 2 makes it possible to switch, for example, from a vertical polarization of the incident wave $E_i$ to a horizontal polarization of the transmitted wave $E_t$.

Phase Shift Circuits

The first phase-shift circuit 4 comprises polarization lines 810 arranged to polarize the first and second switches 40, 41. The polarization lines 810 are electrically conductive tracks, forming control means of the first and second switches 40, 41. The polarization lines 810 are preferentially produced in a metallic material, more preferentially copper. As described previously, the polarization lines 810 of the first phase-shift circuit 4 are advantageously arranged on the second surface 81 of the third dielectric substrate 8. The polarization lines 810 of the first phase-shift circuit 4 are electrically connected to the transmission antenna 3, more specifically to the first radiation surface 30 of the transmission antenna 3, by a via 811 passing through the third dielectric substrate 8. As illustrated in FIG. 3, the polarization lines 810 of the first phase-shift circuit 4 can be linked to bump contacts or decoupling circuits 812. The bump contacts or decoupling circuits 812 are preferentially produced in a metallic material, more preferentially copper.

Figures 4, 5, 6, 7:
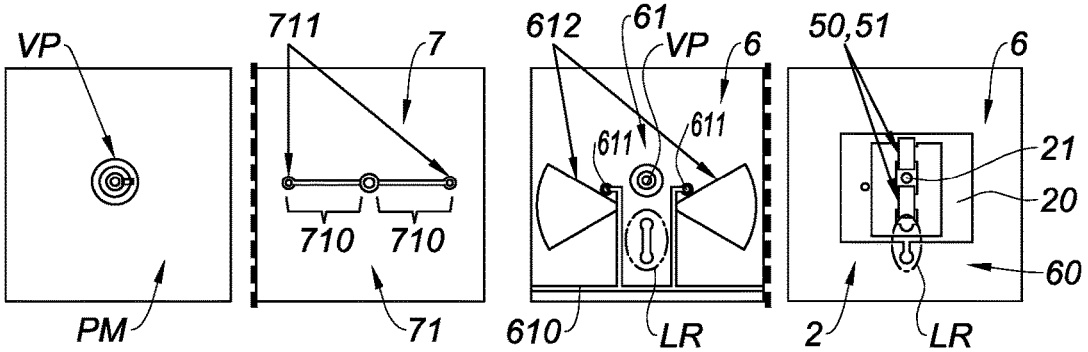
FIG. 4 is a partial schematic view, from above, of a unit cell according to the invention, illustrating the first surface of the second dielectric substrate provided with a ground plane.
FIG. 5 is a partial schematic view, from above, of a unit cell according to the invention, illustrating the second surface of the second dielectric substrate provided with quarter-wave lines.
FIG. 6 is a partial schematic view, from above, of a unit cell according to the invention, illustrating the second surface of the first dielectric substrate provided with switch polarization lines.
FIG. 7 is a partial schematic view, from above, of a unit cell according to the invention, illustrating the first surface of the first dielectric substrate provided with a reception antenna.

Likewise, the second phase-shift circuit 5 comprises polarization lines 610 arranged to polarize the first and second switches 50, 51. The polarization lines 610 are electrically conductive tracks, forming control means of the first and second switches 50, 51. The polarization lines 610 are preferentially produced in a metallic material, more preferentially copper. As described previously, the polarization lines 610 of the second phase-shift circuit 5 are advantageously arranged on the second surface 61 of the first dielectric substrate 6. The polarization lines 610 of the second phase-shift circuit 5 are electrically connected to the reception antenna 2, more specifically to the first collection surface 20 of the reception antenna 2, by a via 611 passing through the first dielectric substrate 6. As illustrated in FIGS. 3 and 6, the polarization lines 610 of the second phase-shift circuit are advantageously linked to decoupling circuits 612. The decoupling circuits 612 are preferentially produced in a metallic material, more preferentially copper.

The first and second switches 40, 41 of the first phase-shift circuit 4 can extend on the first and second radiation surfaces 30, 31 of the transmission antenna 3. As a variant, the first and second switches 40, 41 of the first phase-shift circuit 4 can be formed on the first surface 80 of the third dielectric substrate 8, in the separation zone ZS2 separating the first and second radiation surfaces 30, 31 of the transmission antenna 3. The first and second switches 40, 41 of the first phase-shift circuit 4 are advantageously formed on the first surface 80 of the third dielectric substrate 8, in the separation zone ZS2, monolithically with the transmission antenna 3. "Monolithic" should be understood to mean that the transmission antenna 3 and the first and second switches 40, 41 of the first phase-shift circuit 4 share a single substrate, in this case the third dielectric substrate 8. The first and second switches 50, 51 of the second phase-shift circuit 5 can extend on the first and second collection surfaces 20, 21 of the reception antenna 2. As a variant, the first and second switches 50, 51 of the second phase-shift circuit 5 can be formed on the first surface 60 of the first dielectric substrate 6, in the separation zone ZS1 separating the first and second collection surfaces 20, 21 of the reception antenna 2. The first and second switches 50, 51 of the second phase-shift circuit 5 are advantageously formed on the first surface 60 of the first dielectric substrate 6, in the separation zone ZS1, monolithically with the reception antenna 2. "Monolithically" should be understood to mean that the reception antenna 2 and the first and second switches 50, 51 of the second phase-shift circuit 5 share a single substrate, in this case the first dielectric substrate 6.

As nonlimiting examples, the first and second switches 40, 41; 50, 51 of the first and second phase-shift circuits 4, 5 can be diodes of p-i-n type, MEMS ("Micro Electro-Mechanical Systems"), or of NEMS ("Nano Electro-Mechanical Systems"). The diodes of p-i-n type can be produced in AlGaAs.

Other forms of execution can be envisaged for the switches. As nonlimiting examples, radiofrequency switches of diode, transistor, photodiode and phototransistor type are possible. The choice of a device for controlling the switches depends on the technology selected. As examples, the following devices can be used:

an optical fiber for a switch of photoelectrical type, a laser beam generated by external means and exciting a switch of photoelectrical type, an electromagnetic wave according to the principles of remote feed known from the RFID ("Radio Frequency Identification") field.

The first switch 40 of the first phase-shift circuit 4 alternates between the on state and the off state, while, simultaneously, the second switch 41 of the first phase-shift circuit 4 alternates between the off state and the on state. In other words, at any instant, the first and second switches 40, 41 belonging to the first phase-shift circuit 4 exhibit two opposing states, either on/off, or off/on. The on/on or off/off states are not authorized. Likewise, the first switch 50 of the second phase-shift circuit 5 alternates between the on state and the off state, while, simultaneously, the second switch 51 of the second phase-shift circuit 5 alternates between the off state and the on state. In other words, at any instant, the first and second switches 50, 51 belonging to the second phase-shift circuit 5 exhibit two opposing states, either on/off, or off/on. The on/on or off/off states are not authorized. As illustrated in the table below, it is therefore possible to obtain four phase states. The on state is denoted "1" while the off state is denoted "0".

| First switch 40 | Second switch 41 | First switch 50 | Second switch 51 | Phase state |
|---|---|---|---|---|
| 1 | 0 | 1 | 0 | 0° |
| 1 | 0 | 0 | 1 | 90° |
| 0 | 1 | 1 | 0 | 180° |
| 0 | 1 | 0 | 1 | 270° |

Electrical Connection Between the Reception and Transmission Antennas

The reception antenna 2 and the transmission antenna 3 are electrically connected to one another, in order to be able to power them and couple them, partly by a main via VP, preferably central, preferably metallic. The main via VP passes through an opening formed in the ground plane PM.

The main via VP is not in contact with the ground plane PM so that the main via VP is electrically insulated from the ground plane PM. The main via VP is advantageously connected to the quarter-wave lines 710. As an example, for an operating frequency of 29 GHz, the main via VP has a diameter of the order of 150 μm.

The main via VP is preferentially connected to the reception antenna 2 by a first connection point. The main via VP is preferentially connected to the transmission antenna 3 by a second connection point. Generally, the position of the first and second connection points varies according to the specific geometry of the reception and transmission antennas 2, 3 so as to excite the fundamental resonance mode. In the case of the geometries illustrated in FIG. 3, the first and second connection points are respectively situated close to the center of the reception antenna 2 and of the transmission antenna 3, that is to say at the center of the second collection surface 21 of the reception antenna 2 and at the center of the second radiation surface 31 of the transmission antenna 3. The first and second switches 40, 41 of the first phase-shift circuit 4 extend on either side of the second connection point. The first and second switches 50, 51 of the second phase-shift circuit 5 extend on either side of the first connection point.

More specifically, the main via VP passes through the first, second, and third dielectric substrates 6, 7, 8. Furthermore, the main via VP links the center of the second collection surface 21 to the center of the second radiation surface 31 of the transmission antenna 3. The main via VP extends in a direction corresponding to the normal to the second collection surface 21, and to the normal to the second radiation surface 31.

Bonding Films

The unit cell 1 advantageously comprises a first bonding film FC1 arranged to bond the second surface 71 of the second dielectric substrate 7 onto the second surface 61 of the first dielectric substrate 6. Thus, the first bonding film FC1 is interposed between the first and second dielectric substrates 6, 7. As a nonlimiting example, the first bonding film FC1 can have a thickness of the order of 114 μm when the operating frequency is 29 GHz.

The unit cell 1 advantageously comprises a second bonding film FC2 arranged to bond the second surface 81 of the third dielectric substrate 8 onto the first surface 70 of the second dielectric substrate 7. Thus, the second bonding film FC2 is interposed between the second and third dielectric substrates 7, 8. As a nonlimiting example, the second bonding film FC1 can have a thickness of the order of 114 μm when the operating frequency is 29 GHz.

As nonlimiting examples, the first and second bonding films FC1, FC2 can be produced in a material of thermoplastic copolymer type such as chlorotrifluoroethylene (CTFE). Commercial bonding films that can be cited include CuClad® 6700.

It should be noted that the main via VP passes also through the first and second bonding films FC1, FC2.

Transmitarray

As illustrated in FIG. 1, the transmitarray RT comprises at least one radiation feed S, preferably emitting in a spectral range lying between 4 GHz and 170 GHz. The radiating feed or feeds S are arranged to irradiate a set of unit cells 1.

Figure 2:
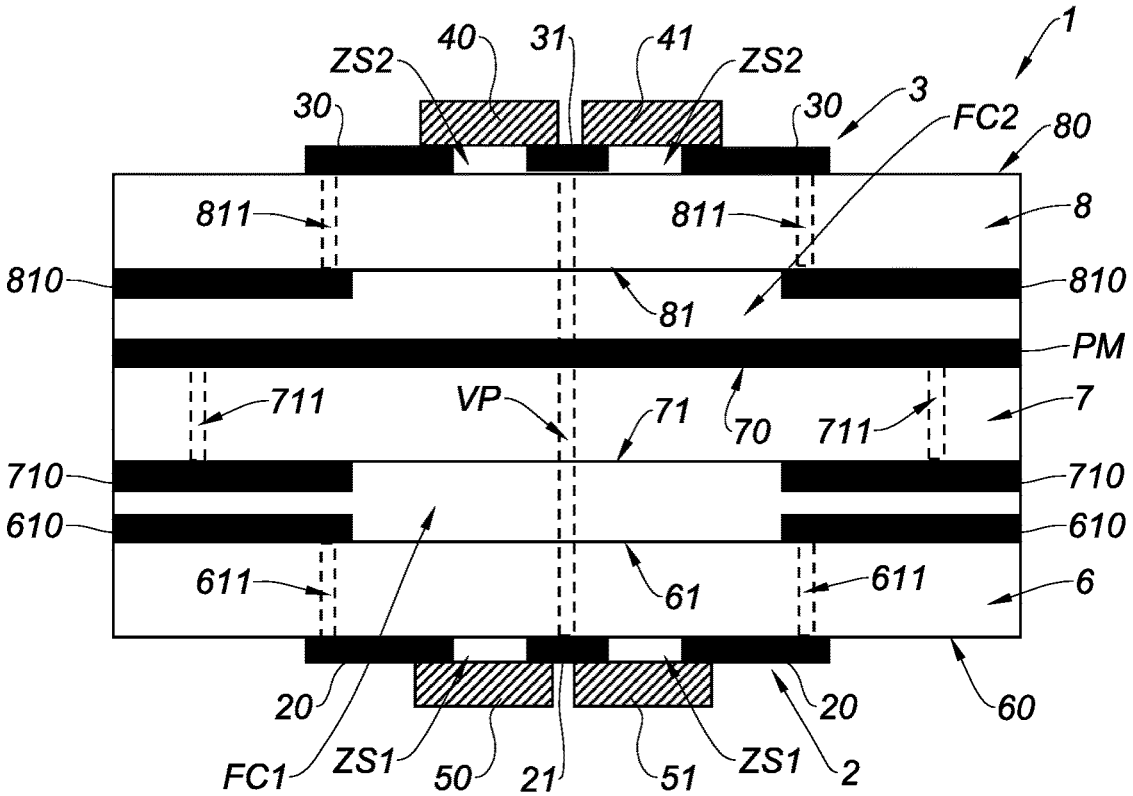
FIG. 2 is a schematic view in cross section of a unit cell according to the invention.

The results obtained for the architecture described in FIGS. 2 and 3 (three dielectric substrates 6, 7, 8 and six metallization levels), and at the operating frequency of 29 GHz, make it possible, by comparison to the prior art and for a square array of 400 unit cells 1:

to increase the directivity by 2.3 dBi (isotropic decibel), to increase the gain by 2.3 dBi, to increase the SLL ("Side Lobe Level") by 5.0 dB.

Furthermore, the transmission band is relatively large (>10%) and the insertion losses are low (<3 dB).

The invention is not limited to the embodiments described. The person skilled in the art will be able to consider the technically operative combinations thereof, and replace them with equivalents.

The invention claimed is:

1. A unit cell of a transmitarray for a reconfigurable antenna with an operating frequency, the unit cell comprising:

a patch reception antenna, intended to receive an incident wave;

a patch transmission antenna, intended to transmit the incident wave with a phase shift, and comprising first and second separate radiation surfaces;

a first phase-shift circuit, configured to define a first pair of phase states for the incident wave; the first phase-shift circuit comprising first and second switches respectively exhibiting an on state and an off state, alternately; the on or off states corresponding to a circulation of a current, respectively authorized or blocked, between the first and second separate radiation surfaces of the transmission antenna;

the unit cell wherein the reception antenna comprises first and second separate collection surfaces;

and wherein the unit cell comprises a second phase-shift circuit, configured to define a second pair of phase states for the incident wave; the second phase-shift circuit comprising first and second switches respectively exhibiting an on state and an off state, alternately; the on or off states corresponding to a circulation of a current, respectively authorized or blocked, between the first and second separate collection surfaces of the reception antenna.

2. The unit cell as claimed in claim 1, comprising a delay line configured such that the second pair of phase states is phase-shifted by 90° relative to the first pair of phase states.

3. The unit cell as claimed in claim 2, in which the delay line extends from the reception antenna.

4. The unit cell as claimed in claim 1, comprising a first dielectric substrate comprising:

a first surface provided with the reception antenna;

a second surface, opposite the first surface, and provided with polarization lines arranged to polarize the first and second switches of the second phase-shift circuit.

5. The unit cell as claimed in claim 4, comprising a second dielectric substrate comprising:

a first surface, provided with a ground plane;

a second surface, opposite the first surface.

6. The unit cell as claimed in claim 5, wherein the second surface of the second dielectric substrate is provided with quarter-wave lines electrically connected to the ground plane.

7. The unit cell as claimed in claim 5, comprising a first bonding film arranged to bond the second surface of the second dielectric substrate onto the second surface of the first dielectric substrate.

8. The unit cell as claimed in claim 5, comprising a third dielectric substrate comprising:

a first surface, provided with the transmission antenna;

a second surface, opposite the first surface, and provided with polarization lines arranged to polarize the first and second switches of the first phase-shift circuit.

9. The unit cell as claimed in claim 8, comprising:

a first bonding film arranged to bond the second surface of the second dielectric substrate onto the second surface of the first dielectric substrate;

a second bonding film arranged to bond the second surface of the third dielectric substrate onto the first surface of the second dielectric substrate.

10. The unit cell as claimed in claim 9, wherein the second surface of the second dielectric substrate is provided with quarter-wave lines electrically connected to the ground plane; the unit cell comprising a main via, arranged to electrically connect the reception antenna and the transmission antenna; the main via passing through the first, second, and third dielectric substrates and the first and second bonding films; the main via being electrically insulated from the ground plane; the main via being connected to the quarter-wave lines.

11. A reconfigurable antenna with operating frequency, comprising a transmitarray comprising a set of unit cells as claimed in claim 1.

* * * * *